US005269600A

United States Patent [19]

Arreola et al.

[11] Patent Number: 5,269,600

[45] Date of Patent: Dec. 14, 1993

[54] MOVABLE DIVIDER

[75] Inventors: Miguel Arreola, Ontario, Calif.; Matthew Denburg, La Habra, both of Calif.

[73] Assignee: Russ Bassett Company, Whittier, Calif.

[21] Appl. No.: 790,998

[22] Filed: Nov. 12, 1991

[51] Int. Cl.[5] ..... A47B 88/00

[52] U.S. Cl. ..... 312/348.3; 211/184; 220/542

[58] Field of Search ..... 312/348.3, 348.5; 211/59.2, 59.4, 162, 184; 220/529, 532, 541, 542

[56] References Cited

U.S. PATENT DOCUMENTS

| | | | |
|---|---|---|---|
| 1,940,048 | 12/1933 | Cutler | 312/348.3 X |
| 2,746,457 | 5/1956 | Musacchia | 220/542 |
| 3,501,019 | 3/1970 | Armstrong et al. | 220/529 X |
| 3,892,451 | 7/1975 | Bruins | 312/348.3 |

FOREIGN PATENT DOCUMENTS

| | | | |
|---|---|---|---|
| 1436160 | 10/1968 | Fed. Rep. of Germany | 220/532 |

*Primary Examiner*—Kenneth J. Dorner
*Assistant Examiner*—Brian K. Green
*Attorney, Agent, or Firm*—George J. Netter

[57] ABSTRACT

A movable divider wall (28) for a drawer (10) includes a cam (32) secured to each opposite end, which cam is relatively compressible across a first direction and only slightly compressible across other directions. Channels (20, 22) are secured to the internal surfaces of opposing drawer panels and each presents a longitudinal recess (24) facing toward the other which are so dimensioned as to receive a cam (32). With the cam relatively compressible direction extending transversely of the recess (24) the cam (32) and divider wall (28) may be adjustably positioned within the drawer. Rotating the divider wall to a position where the cam slightly compressible direction is transverse to the channel recesses locks the cams and divider wall relative to the drawer.

5 Claims, 2 Drawing Sheets 10
12
14
15
16
18
20
22
24
25
26
28
30
32

MOVABLE DIVIDER

BACKGROUND OF INVENTION

1. Field of the Invention.

The present invention relates generally to a selectively movable divider or partition for use in a drawer such as a file cabinet drawer.

SUMMARY OF THE INVENTION

In accordance with the present invention there is provided a movable divider wall or partition for use in a drawer such as a file cabinet drawer, for example, to selectively adjust drawer volume and in that way aid in maintaining upright position of materials carried therein.

Assuming that it is desired to have the movable divider wall extend from the front to the rear of a drawer then the movable direction is transversely thereto or from one drawer side wall to another. In order to practice the present invention the basic drawer construction does not have to be modified in any respect other than to receive front and rear drawer panel channels secured to the drawer front and rear panels, respectively, each of which has on an inner face a continuous recess extending throughout substantially its full length.

The divider wall or partition is a sheet of rigid material of appropriate dimensions to extend from the front drawer panel to the rear drawer panel. On both ends of the divider wall or partition there is affixed a cam which has a first direction enabling receipt within the recess of the front and rear channels. This cam is substantially rigid in the first direction as measured in the partition plane and is relatively resilient along a line transverse to the first direction. With the cams located in each of the front and rear panels when the divider wall or partition is oriented with its plane normal to the drawer bottom this will cause the rigid dimension of the cam to wedge in the panel recess both at the front and the rear of the drawer and maintain the position of the divider accordingly. When it is desired to relocate the divider the divider partition is rotated so that its plane is somewhat parallel to the drawer bottom which will now cause the cam to have its resilient sides in contact with the channel recess sides and this enables sliding of the partition and cams along the channels to a new desired position of adjustment.

DESCRIPTION OF A PREFERRED EMBODIMENT

Figures 1, 2:
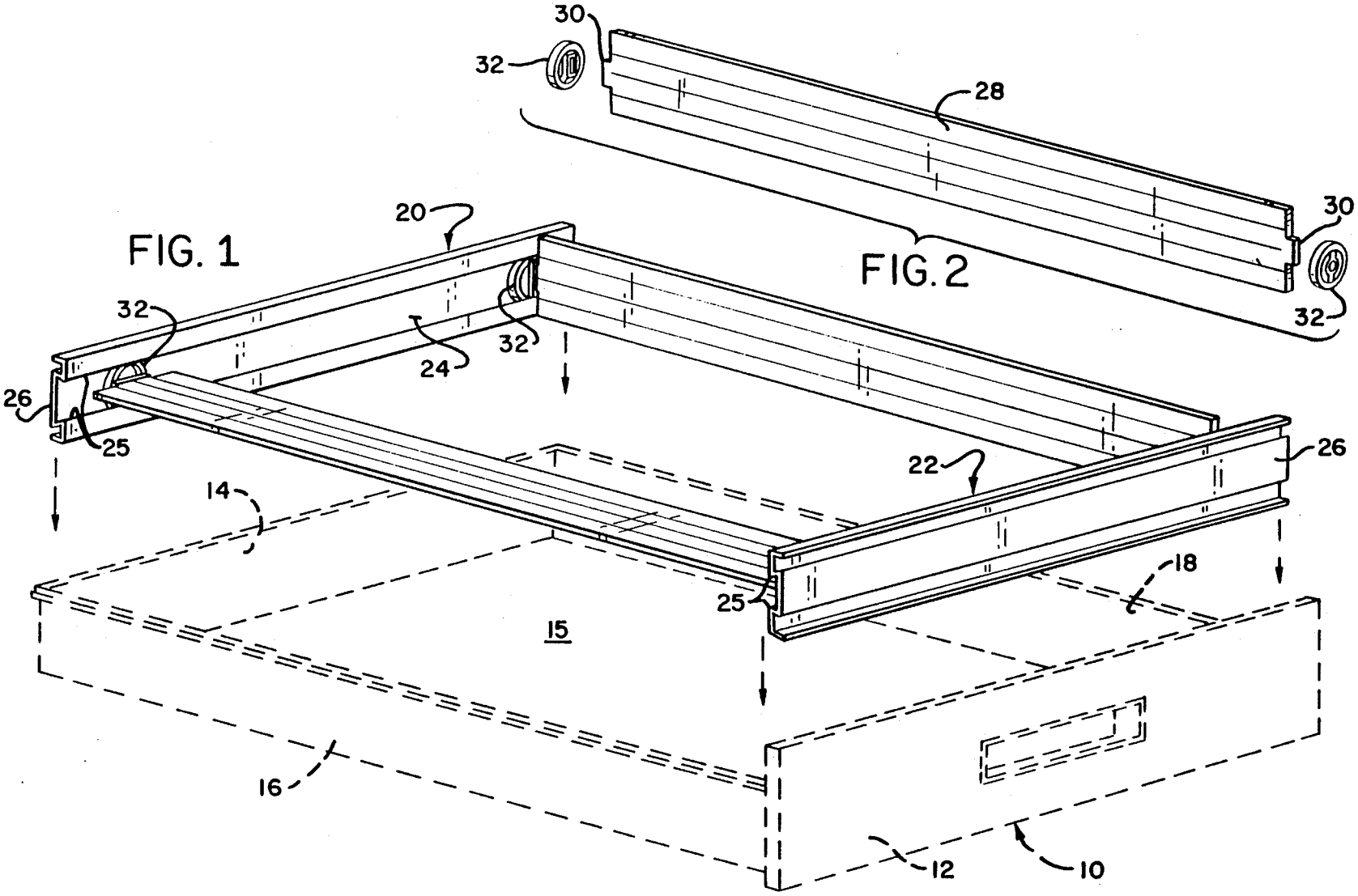
FIG. 1 depicts a movable divider wall of this invention about to be mounted in a drawer.
FIG. 2 shows the movable divider wall in exploded view.
Figure 3:
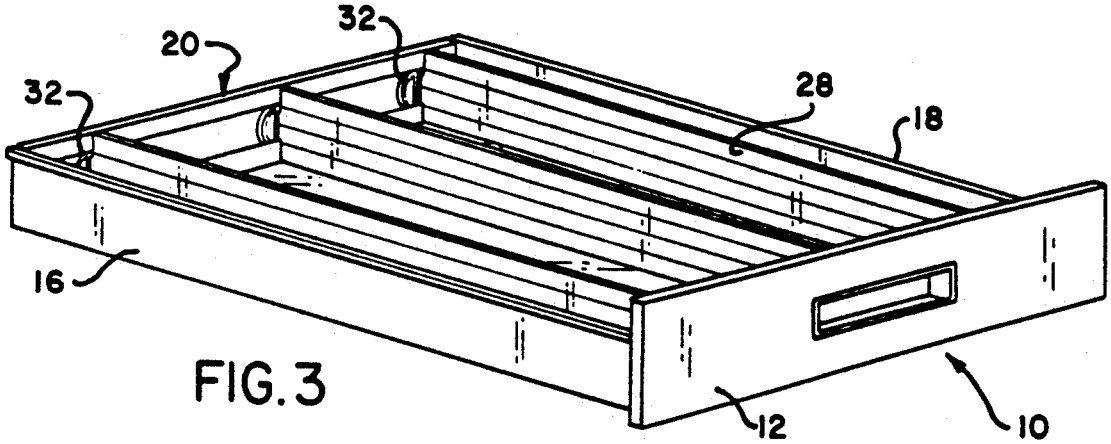
FIG. 3 is a perspective view of a drawer with several divider walls of the invention assembled therein.

Turning now to the drawings and particularly FIG. 1 there is shown in phantom line a drawer 10 having a front panel 12, rear panel 14, bottom 15 and two side panels 16 and 18 all connected together in conventional manner to form an open top drawer. For purposes of illustration only the invention will be described as providing a partition movable transversely of the drawer front panel 12 to achieve selective storage facilities of selectively variable dimensions as measured across substantially the drawer width.

Figure 4:
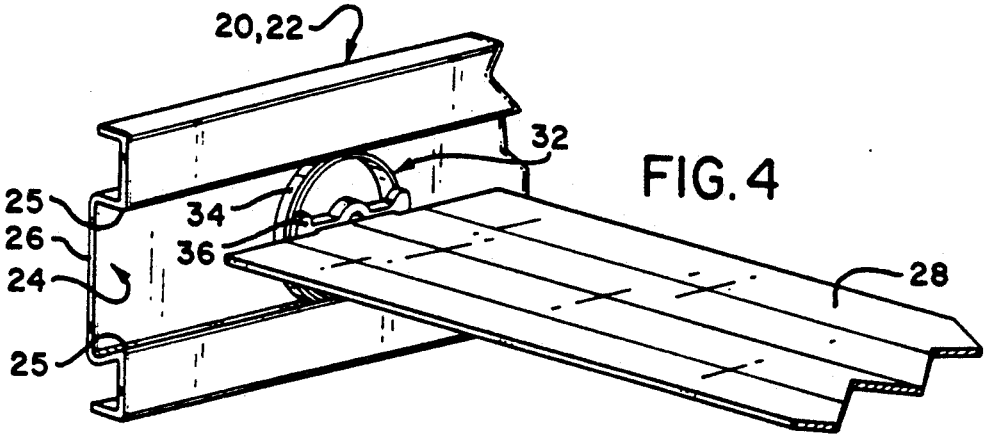
FIG. 4 is a perspective, partially fragmentary, view showing the divider wall in unlocked mode for adjustable positioning.
Figure 5:
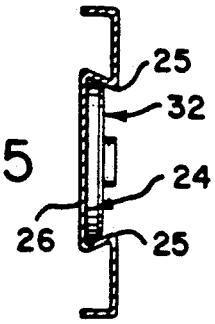
FIG. 5 is an end elevational, sectional view of a divider wall and cam shown in unlocked mode.
Figure 6:
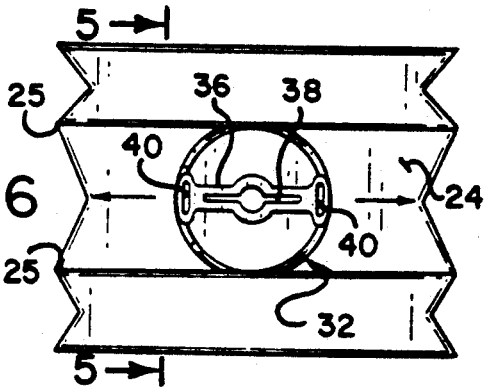
FIG. 6 is a front elevational view of FIG. 5.

Turning additionally to FIGS. 4 and 5, a pair of channel assemblies 20 and 22 are of substantially identical construction and are, respectively, affixed to the rear panel 14 and the front panel 12 on the inside surfaces facing one another. The channel assemblies may be secured to the drawer panels in any of several conventional ways, e.g., welding. In particular, each of these channel assemblies, constructed of either molded plastic or formed metal sheeting, includes a recess 24 opening into the drawer space that extends along and may be aligned with the center line of the channel. The recess is formed by parallel edges 25 that faces into the drawer space and bottoms out in a back wall portion 26 of greater width than the space between edges 25.

A divider wall 28 can be constructed of any suitable rigid sheetlike material such as molded plastic or sheet steel, for example, and is of generally rectangular geometry with a length reaching between the two channel assemblies 20 and 22 and a height less than that of the drawer panels, but sufficient to provide the desired dividing function for stored materials (e.g., files). Reduced dimensional portions extend from opposite ends of each of the divider walls forming tabs 30 which are in the same plane as the partition and whose purpose will be discussed later (FIG. 2).

Each end of the divider wall is provided with a positioning cam 32 that cooperates in a way to be described in selectively permitting either of the partition in a direction parallel to the channel assembly recesses or to become lockingly engaged within the recesses defining and maintaining a desired adjustment location. As can be seen best in FIGS. 4–8, a positioning cam preferably has a generally ringlike or annulus body 34 constructed of a material (e.g., molded plastic) that is somewhat flexible enabling the annulus to be compressed across a first direction reducing the outer maximum dimension somewhat along that direction. The outer diameter and thickness dimensions of the annulus are such as to enable mounting within a channel assembly recess 24 by compressing it across the first direction or diameter, after which on release the annulus is fully seated within the recess (FIG. 4).

A reinforcing and locking strut 36 extends across the annulus 36 along a second direction or diameter and has its two ends affixed thereto. The strut 36 extends outwardly from the annulus face and includes an elongated slot 38 aligned with the first direction of the annulus and dimensioned to fittingly receive a divider wall tab 30. At the outer end of each strut slot 38 there is provided a relief slot 40 that extends transversely of the elongated slot. The strut is thicker than the annulus body 34 and more rigid so that although the bending characteristics of the overall cam 32 are relatively small when applied transversely to the strut 36, they are substantially increased when applied along the axis of the strut. Accordingly, as shown in FIGS. 4 and 5, because of the relative flexibility of the positioning cam 32 when the divider wall is turned to a position such that the divider plane is relatively parallel to the drawer bottom, the positioning cams 32 on each ends of the divider are relatively loosely received within their respective recesses 24 and can be easily positioned along the recess for desirable relocation. That is, when in the adjustable mode the strut 36 is generally parallel to the recess axis.

Figure 7:
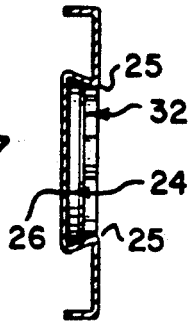
FIG. 7 is an end elevational view similar to FIG. 5 only showing the cam in locked mode.
Figure 8:
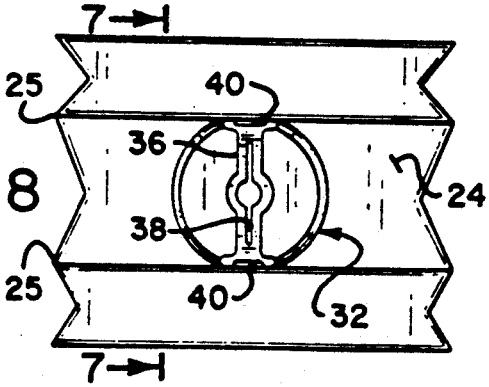
FIG. 8 is a front elevational view of FIG. 7.

On the other hand, when the divider wall and its positioning cams are located at a desired position along the divider wall, the divider wall is then rotated to an upright position with the wall plane normal to the drawer bottom which turns the positioning cam to that shown in FIGS. 7 and 8 where the reinforcing and locking strut 36 extends transversely of the recess longitudinal axis. In this latter position, the strut 36, by virtue of its relatively greater rigidity, causes the cam to wedge between opposite edges 25 of the recess thereby securing the divider wall at a new position of adjustment.

Although the invention has been described in connection with a preferred embodiment, it is to be understood that those skilled in the appertaining art may effect modifications that come within the spirit of the invention and described and defined in the appended claims. For example, although the cam means 32 is described as annular it is contemplated that other geometric forms may be advantageously employed.

What is claimed is:

1. A movable divider wall assembly, comprising:

first and second channels arranged in a facing generally parallel spaced apart relation, each said channel having an elongated recess with said recesses facing one another;

divider wall means having first and second opposite ends;

individual cam means respectively secured to the first and second divider wall means ends, each said cam means including an annular body of compressible material and a reinforcing and locking strut unitary with said annular body and extending generally between opposite sides of said body, said strut providing a means for preventing compression of said body solely in a first direction along said strut;

said cam means annular bodies being respectively positioned within the first and second channel recesses, and the dimensions of the recesses and annular bodies being such that when said first direction of an annular body is aligned with a given direction with respect to the recess the said body is wedged within the recess and when a body first direction is arranged at orientations other than aligned with the given direction the body is free to move along the recess.

2. A movable divider wall assembly as in claim 1, in which the divider wall means includes a separate tab secured to each end, and each cam means has a first slot for receiving a divider wall tab therein.

3. A movable divider wall assembly as in claim 2, in which the reinforcing and locking strut further includes outwardly of each end of the first slot a relief slot extending transversely to the first slot.

4. A movable divider wall as in claim 1, in which the divider wall means is generally planar and the reinforcing and locking strut of each cam means lies generally within the plane of said wall means.

5. A movable divider wall as in claim 4, in which the recess has generally parallel spaced apart edges defining an access opening to the said recess and said cam means annular body is wedged within the said recess when the annular body first direction is substantially at 90 degrees to the recess edges.

* * * * *